US007985033B2

(12) United States Patent
Matsuoka

(10) Patent No.: US 7,985,033 B2
(45) Date of Patent: Jul. 26, 2011

(54) COSMETIC APPLICATION DEVICE

(75) Inventor: Kazuo Matsuoka, Tokyo (JP)

(73) Assignee: Katsushika Co., Ltd., Tokyo (JP)

( * ) Notice: Subject to any disclaimer, the term of this patent is extended or adjusted under 35 U.S.C. 154(b) by 61 days.

(21) Appl. No.: 12/457,473

(22) Filed: Jun. 11, 2009

(65) Prior Publication Data

US 2009/0274507 A1 Nov. 5, 2009

Related U.S. Application Data

(62) Division of application No. 11/346,628, filed on Feb. 3, 2006, now abandoned.

(30) Foreign Application Priority Data

Aug. 4, 2004 (JP) ..... 2004-228594

(51) Int. Cl.
*A46B 3/08* (2006.01)
*A46B 11/00* (2006.01)
*A45D 34/04* (2006.01)

(52) U.S. Cl. ..... 401/129; 15/168; 15/191.1; 15/DIG. 4

(58) Field of Classification Search ..... 15/167.3, 15/168–171, 174, 191.1, 192, 193, 204, 205, 15/DIG. 4; 401/129, 290
See application file for complete search history.

(56) References Cited

U.S. PATENT DOCUMENTS

| | | | | | |
|---|---|---|---|---|---|
| 235,841 | A | * | 12/1880 | Wright | 15/204 |
| 700,050 | A | * | 5/1902 | Humphrey | 15/204 |
| 2,296,949 | A | * | 9/1942 | Roberts | 15/205 |

FOREIGN PATENT DOCUMENTS

| | | |
|---|---|---|
| JP | 57-81713 | 5/1982 |
| JP | 58-29403 | 2/1983 |
| JP | 2000-135886 | 5/2000 |
| JP | 2003-169713 | 6/2003 |

* cited by examiner

*Primary Examiner* — Mark Spisich
(74) *Attorney, Agent, or Firm* — Westerman, Hattori, Daniels & Adrian, LLP

(57) ABSTRACT

A cosmetic application device includes the application stick and the application portion having the brush fixedly mounted at the end of the application stick by the cylindrical capsule, wherein corner portions of the inner surface and the outer surface of the capsule are chamfered so as not to leave sharp edges. Also, the thin and soft protection tube is disposed between the brush and the capsule with the end of the tube extending slightly beyond the end of the capsule, thereby preventing the brush from being bent at an acute angle to avoid broken hair of the brush.

2 Claims, 8 Drawing Sheets

COSMETIC APPLICATION DEVICE

CROSS-REFERENCE TO RELATED APPLICATION

This application is a Divisional of U.S. patent application Ser. No. 11/346,628, filed Feb. 3, 2006, the entire contents of which are hereby incorporated by reference.

TECHNICAL FILED

The present invention relates to cosmetic application device for applying cosmetic material such as face powder, rouge, lip gloss, eyeliner, manicure or the like, more specifically to a cosmetic application device having a brush mounted by a capsule at an end of an application stick.

BACKGROUND OF THE INVENTION

A container for liquefied cosmetic material such as rouge, lip gloss, eyeliner, manicure or the like comprises, as shown in FIG. 3, a container body 11 for storing liquefied cosmetic material 10, a cap 1 to mate with a mouth 12 of the container body 11 for closing the container body 11, an application stick 4 depending from the top of a mating hole 2 to be inserted into the container body 11, an application portion 6 having a brush 7 at an end of the application stick 4 by a capsule 8 in form of a metal sleeve, and a wiper 14 mounted in the mouth portion 12 of the container body 11 in the condition for allowing the application stick 4 to penetrate for the purpose of sweeping off the liquefied cosmetic material 10 attached to the application stick 4 when the application stick 4 passes through.

However, as shown in FIG. 6, sine the diameter of a wipe-off hole 16 at a wipe-off portion 15 of the wiper 14 is smaller than the outer diameter of the application stick 4 and a capsule 8 at the application portion 6, outer hair of the brush 7 at the application portion 6 tends to be bent in the opposite direction and broken when the application portion 6 passes through the wipe-off portion 15 of the wiper 14 during insertion of the application stick 4 into the container body 11. The broken hair 17 does not return to its original position as shown in FIG. 7. Accordingly, if there is any broken hair 17 at the application portion 6, there encounters a fatal problem of difficulty in applying the cosmetic material with clear outline, applying the cosmetic material at undesired positions, or requiring special care for inserting or extracting the application device.

As a measure to this problem, a Patent Document JP2003-169713 A1 proposes a container for liquefied cosmetic material, in which an open portion at the end of a capsule is made to have a larger thickness toward inside in the radius direction and the inner diameter of the open portion at the end of the capsule is made smaller than the inner diameter at the wipe-off portion of the wiper.

SUMMARY OF THE INVENTION

In such construction, since the outer diameter of the brush at the application portion is smaller than the inner diameter of the wipe-off portion of the wiper, the brush of the application portion may pass through the wipe-off portion of the wiper without touching if the application stick is accurately inserted into the wipe-off portion of the wiper. However, this is practically impossible and the brush is most likely to contact the inner wall of the wiper during insertion of the application portion, thereby bending up hair of the brush. As a result, this is not a fundamental solution to the problem.

Moreover, in a cheek brush for applying face powder, powder foundation, etc., a lip brush for applying rouge, lip gloss, etc., or the like, it is typical to cover the application portion with a cap for protecting the application portion. When the application portion is inserted into or extracted from the cap, one encounters the same problem as the above, i.e., bending up hair of the brush to break it.

In a construction comprising an application stick 4 and an application portion 6 having a brush 7 mounted at the end of the application stick 4 by a cylindrical capsule 8, corner portions 9 of the inner surface and outer surface at the end of the capsule 8 are chamfered so that no edge is remains.

In a construction comprising an application stick 4 and an application portion 6 having a brush 7 mounted at an end of the application stick 4 by a cylindrical capsule 8, a thin and soft protection tube 19 is provided between the brush 7 and the capsule 8 and the end of the tube 19 extends slightly beyond the end of the capsule 8.

As described hereinabove, the main cause of the bending hair 17 is that the application portion 6 is inserted into the open portion 12 of the container body 11 to pass through the wipe-off portion 15 of the wiper 14 while the brush 7 is bent up, thereby leaving hair of the brush 7 in a bend-up condition. And the cause of the bent-up hair 17 not returning to the original condition is that, as shown in FIG. 7, a fold 18 is formed in the brush 7. The reason why the fold 18 is caused is because of the shape at the corner portions 9 of the inner surface and the outer surface at the end of the capsule 8. In the normal manufacturing step of the capsule 8, a metal plate is formed in a predetermined cylindrical shape before being cut to a desired length. As a result, the corner portions 9 at the end portion of the normal capsule 8 remain clean edge as it was cut and the brush 7 is bent along the edge, thereby causing the fold 18 in the brush 7 and thus causing the un-recoverable bent-up hair 17.

A chamfered construction not to cause an edge at the corner portion 9 of the inner surface and the outer surface at the end of the capsule 8 of the application portion 6 according to the present invention is shown in FIG. 1 and corner portions 9 at the end of the capsule 8 are chamfered at both of the inner and outer surfaces. Additionally, the shape of the chamfer is arc so that no edge remains. Accordingly, even if the application portion 6 may be forced to pass through the wipe-off portion 15 of the wiper 14 while the brush 7 is bent up in the opposite direction, the chamfered corner portions 9 at the end of the capsule 8 does not cause any fold in the brush 7, thereby allowing the brush 7 to return to the original condition because of its own recovery force.

Moreover, a thin and soft protection tube 19 is placed between the brush 7 of the application portion 7 and the capsule 8 with the end of the tube 19 extending slightly beyond the end of the capsule 8. In this construction, the protection tube 19 acts as a cushion to protect the brush 7 not to be bent at an acute angle. As a result, even if the brush 7 is bent up in the opposite direction at the time when the application portion 6 passes through the wipe-off portion 15 of the wiper 14, the protection tube 19 protects the brush 7 so that the hair is not bent at an acute angle as shown in FIG. 2, thereby avoiding any fold in the brush 7 and returns to the original condition due to its recovery force of the brush 7.

As understood from the above description, the cosmetic application device according to the present invention taking a construction of chamfering not to have an edge in the corner portion 9 at the end of the capsule 8 of the application portion 6 or placing a thin and soft protection tube 19 between the brush 7 of the application portion 6 and the capsule 8 with the end of the tube 19 slightly extending from the end of the capsule 8, thereby effectively avoiding to cause any unrecoverable fold in the brush 7 even if the application portion 6 is forced to pass through the wipe-off portion 15 of the wiper 14 with the brush 7 bent up in the opposite direction or the cap 1 is closed. As a result, the cosmetic application device according to the present invention fundamentally overcomes the problem of the bent-up hair 17 of the brush 7, thereby enabling to use it repeatedly and semi-permanently without causing any folded hair 17.

Now, a description will be made on an embodiment of a container for liquefied cosmetic to which the present invention is applied (see FIG. 3). A cap 1 is provided with a mating hole 2 upwardly from the bottom surface. A female screw 3 is formed on the inner surface of the mating hole 2 and an application stick 4 is depending from the top surface of the mating hole 2 at the center thereof A seal 5 is attached at the outer periphery of the application stick 4. An application portion 6 is provided at the end of the application stick 4.

The application portion 6 comprises a brush 7 that is similar to a writing-brush with one end inserted into and fixed with adhesive or the like in a capsule 8 made of metal cylinder such as an aluminum pipe. And the back end of the capsule 8 is fixedly mounted on one end of the application stick 4.

The container body 11 in which a liquefied cosmetic material 10 such as rouge, lip-gloss, eyeliner, manicure or the like is stored is provided with a mouth portion 12 at the top thereof for mating with the cap 1. A male screw 13 is formed on the outer surface of the mouth portion 12 for mating with the female screw 3 of the cap 1. When the cap 1 is mated or fitted with the container body 11, the upper end of the mouth portion 12 of the container body 11 abuts against the seal 5 for closing the container body 11 in a liquid tight manner.

Additionally, a wiper 14 made of an elastic material such as rubber or the like is inserted into and fixedly mounted in the mouth portion 12 of the container body 11. The wiper 14 is formed with a valve-like wipe-off portion 15 in which a wipe-off hole 16 is formed for allowing the application stick 4 of the cap 1 to pass through. The inner diameter of the wipe-off hole 16 is slightly larger than the outer diameter of the application stick 4. As a result, when the application stick 4 and the application portion 6 thereof pass through the wipe-off portion 15, the liquefied cosmetic material 10 attached to the application stick 4 is effectively wiped off.

It is to be noted that the cross sectional shape of the capsule 8 should not be restricted only to circular, but may be other shapes such as flat oval, track shape or any other non-circular shape. As shown in FIG. 4, it is also possible to place the seal 5 at the top end of the mouth portion 12 of the container body 11 so that the portion is made to abut against the top surface of the mating hole 2 of the cap 1 for closing the container body 11 in a liquid tight manner. In this case, the upper end of the wiper 14 is made to extend so as to cover the upper end of the mouth portion 12 of the container body 11, thereby integrally forming the seal 5 and the wiper 14. Furthermore, as shown in FIG. 8, it is also possible to embody the application device in such a manner that the cap 1 fits with the application portion 6.

In the above construction, the inner and outer edge portions 9 of the end surface of the capsule 8 are chamfered. Such chamfered surface may be any shape such as arc or straight as long as no sharp edge remains at the end portion of the capsule 8. (See FIG. 1)

In the above construction, a plastic film tube 19 made from PET film, PP film polyester film or the like may be inserted and fixedly mounted between the brush 7 at the end surface of the capsule 8 and the capsule 8. Preferably, the plastic film tube 19 is thin in the range of about 0.05 mm in thickness and flexible to a certain extent. And the end of the tube 19 extends slightly beyond the end of the capsule 8. (See FIG. 2)

Although the application stick 4 and the capsule 8 at the application portion are described as separate components in the above embodiments, it is possible to embody the present invention by making the application stick 4 and the capsule 8 as a unitary member. In this case, the application stick 4 and the capsule 8 are made from the same material.

Figure 1:
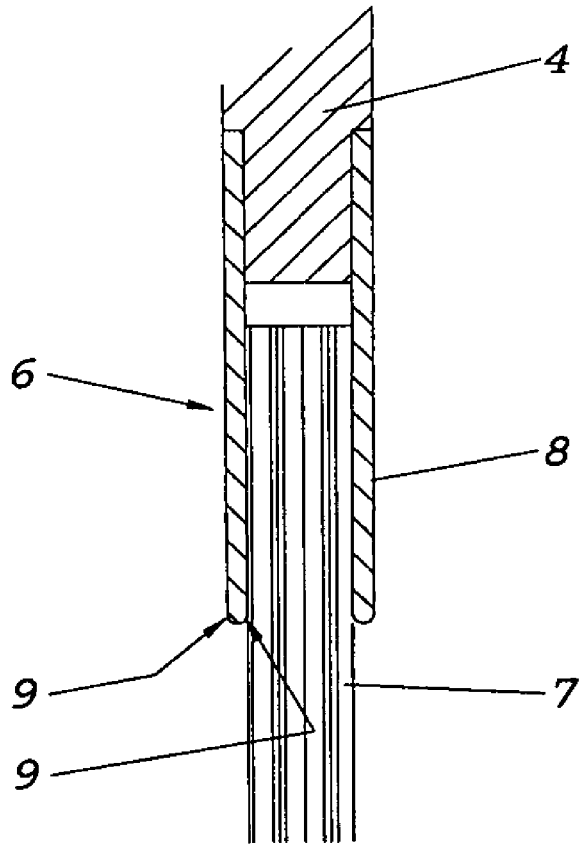
FIG. 1 is a magnified cross section view of the capsule portion of the embodiment 1 of the container for liquefied cosmetic material according to the present invention.
Figure 2:
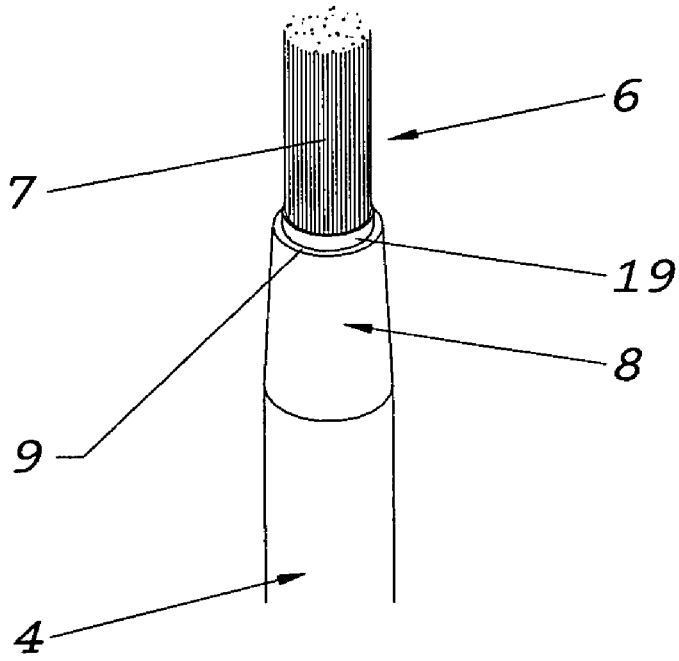
FIG. 2 is a magnified cross section view of the capsule portion of the embodiment 2 of the container for liquefied cosmetic material according to the present invention.
Figure 3:
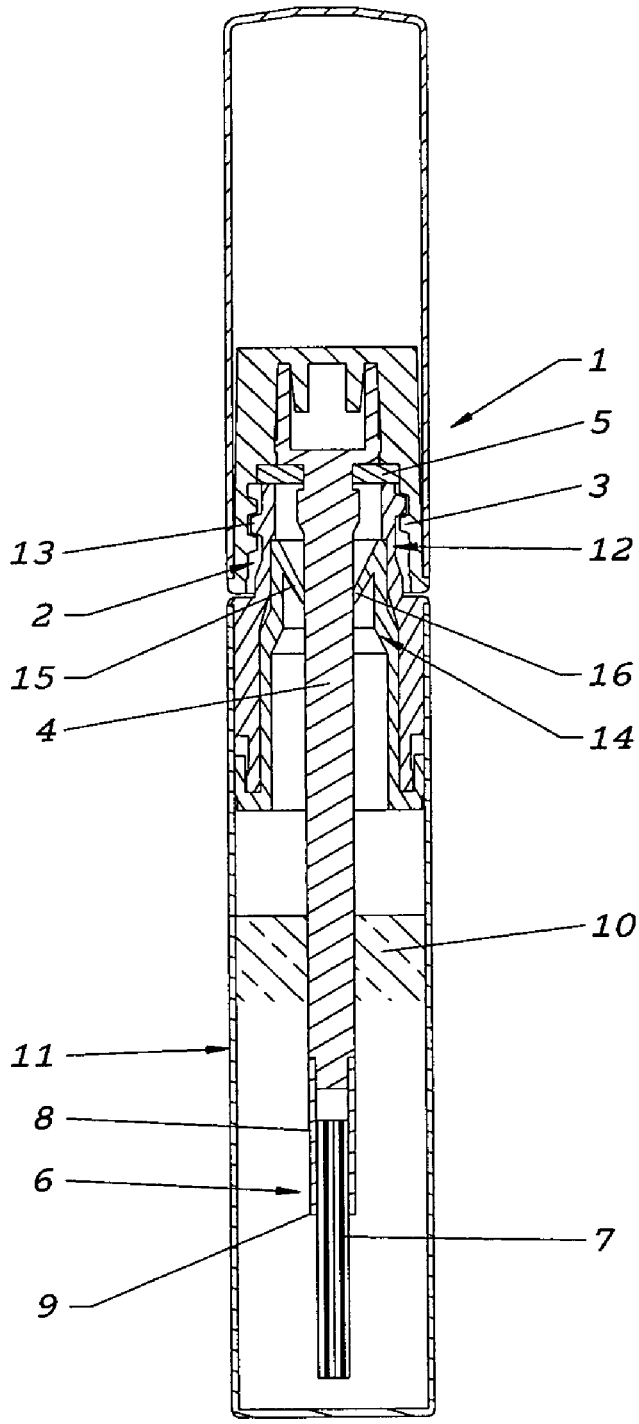
FIG. 3 is a cross section front view of the container for liquefied cosmetic material to which the present invention is applied.
Figure 4:
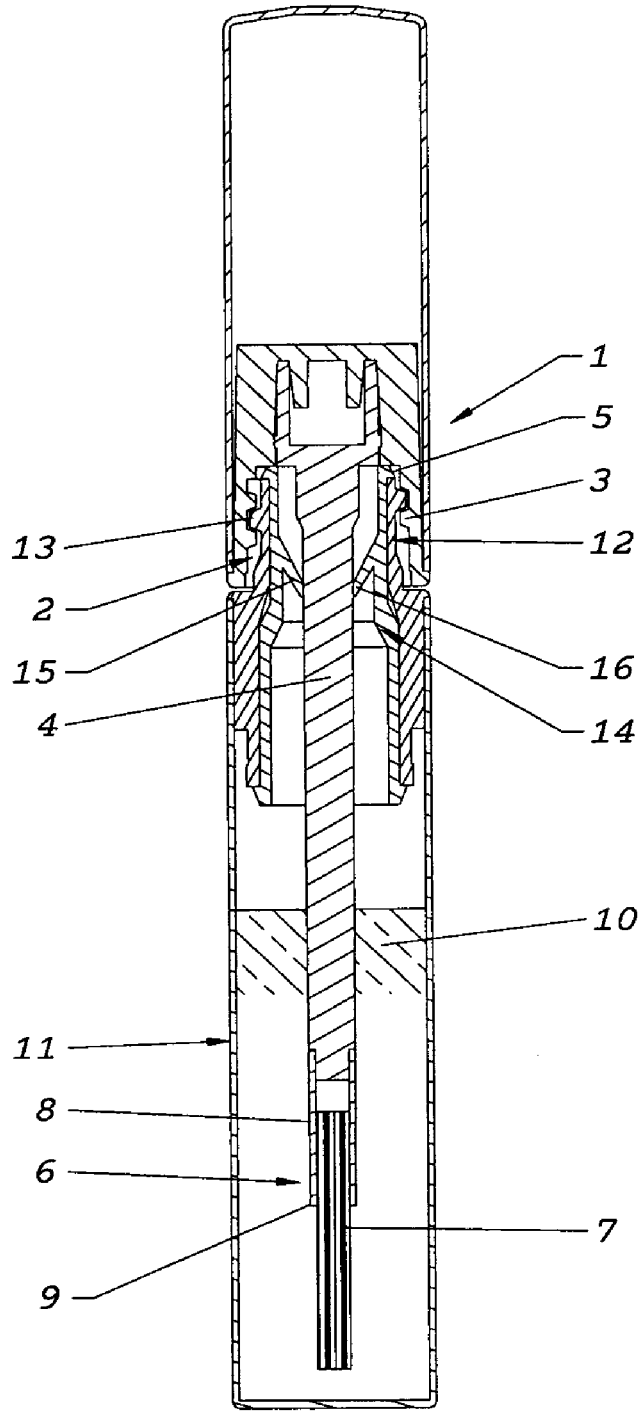
FIG. 4 is a cross section front view of one example of the container for liquefied cosmetic material to which the present invention is applied.
Figure 5:
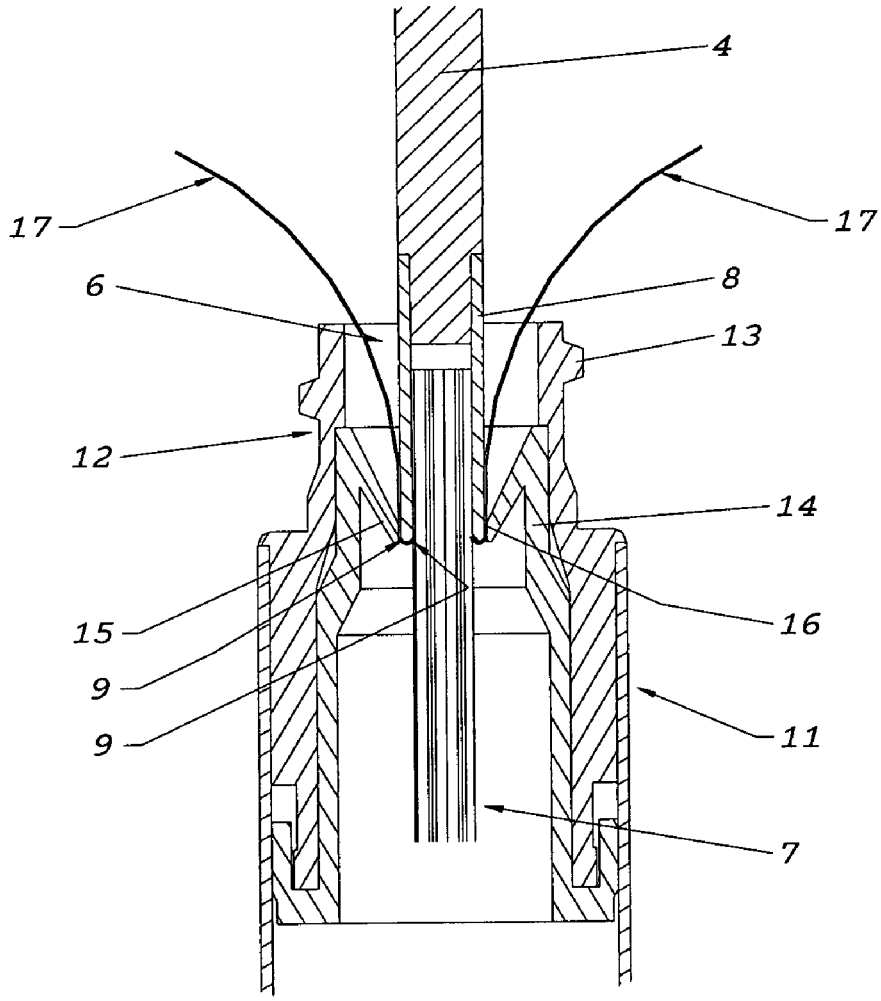
FIG. 5 is a magnified partial cross section view to illustrate the condition of the capsule of the liquefied cosmetic application device according to the present invention passing through the wipe-off portion of the wiper.
Figure 6:
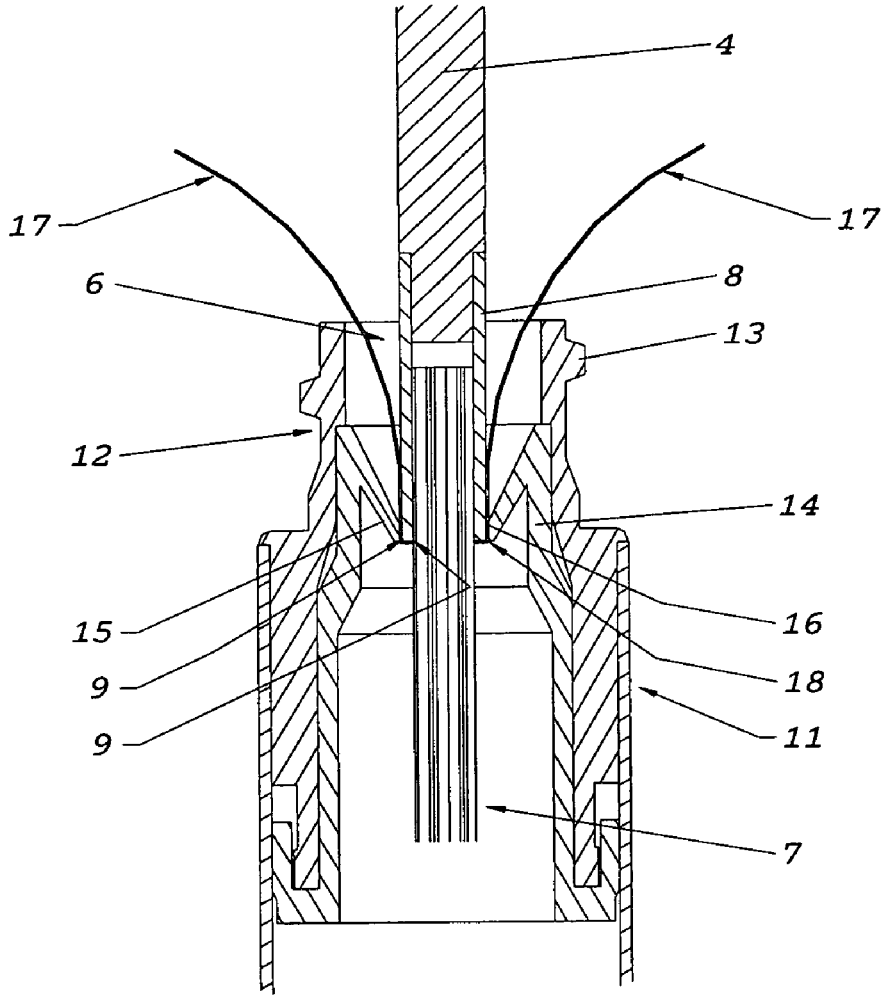
FIG. 6 is a magnified partial cross section view to illustrate the condition of the capsule of a conventional liquefied cosmetic application device passing through the wipe-off portion of the wiper.
Figure 7:
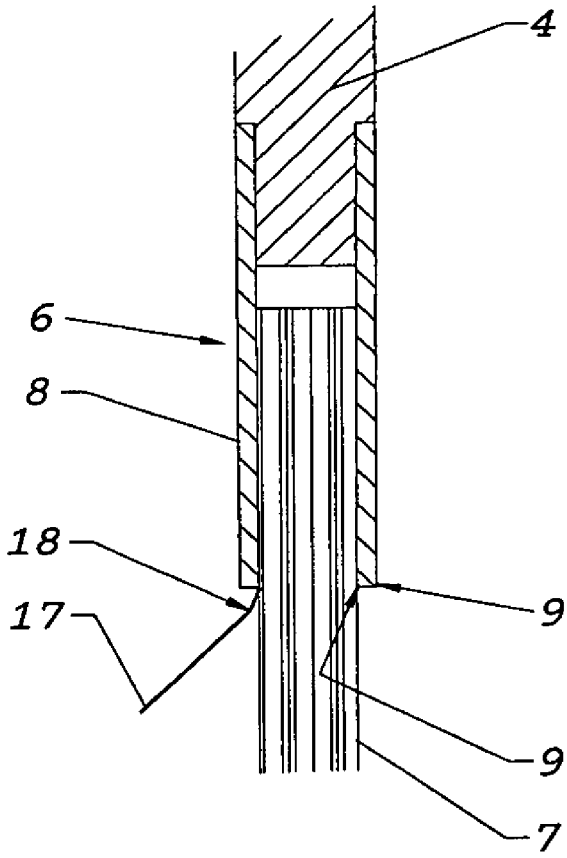
FIG. 7 is a magnified partial cross section view to illustrate the condition of causing broken hair of the brush in a conventional liquefied cosmetic application device.
Figure 8:
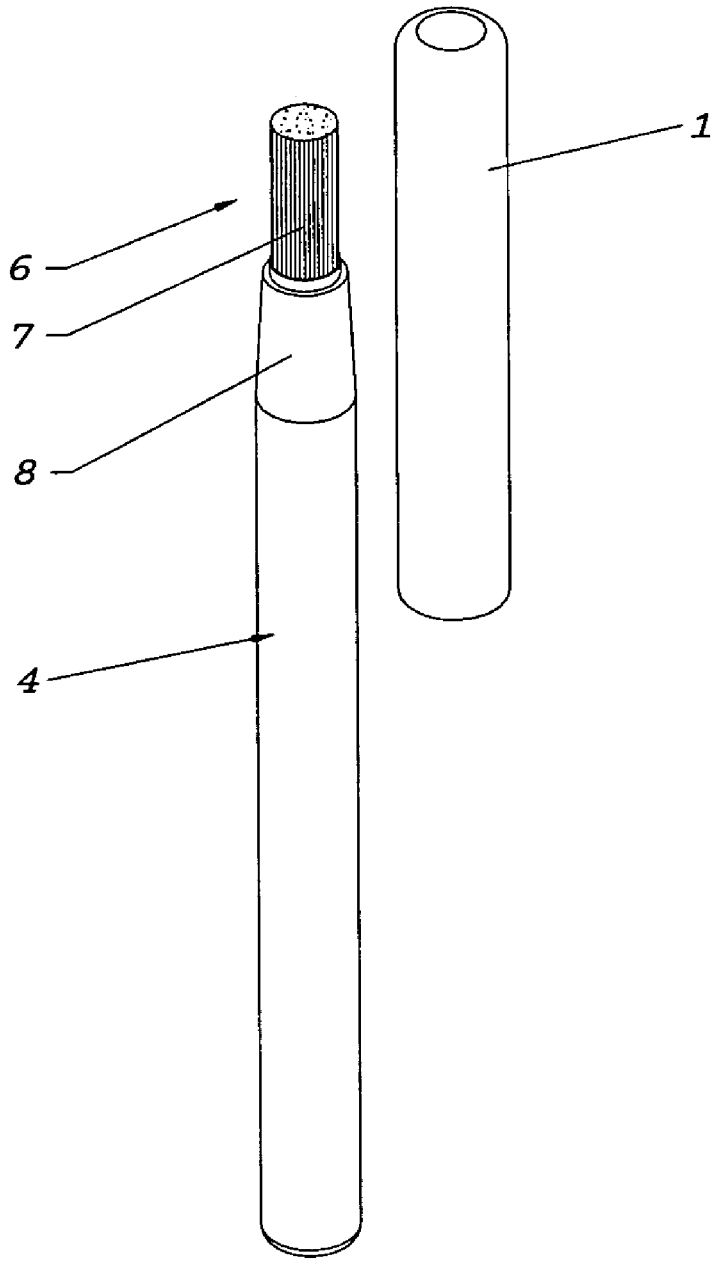
FIG. 8 is a front cross section view of one example of the application device embodying the present invention.

I claim:

1. A cosmetic application device, comprising:

a container adapted to hold a liquid, said container including a wipe-off portion surrounding a wipe-off hole, an application stick, and an application portion having a brush fixedly mounted at the end of the application stick by a cylindrical capsule, wherein said application portion is insertable into said container through said wipe-off hole such that the liquid on said brush is wiped off by said wipe-off portion, wherein a thin and soft protection tube is disposed between the brush and the cylindrical capsule, with the end of the thin and soft protection tube extending slightly beyond the end of the cylindrical capsule, and wherein said thin and soft protection tube flexibly bends such that hairs of said brush are not bent at an acute angle when the application portion passes through the wipe-off hole of said wiper.

2. The cosmetic application device of claim 1, wherein the cylindrical capsule and the application stick are formed as a unitary member.

* * * * *